United States Patent [19]

Shellow et al.

[11] 3,972,080

[45] Aug. 3, 1976

[54] SOFA BED

[75] Inventors: Robert M. Shellow, North Miami, Fla.; Urban A. Weidner, Park Ridge, Ill.

[73] Assignee: Mak-Kraft Creations, Inc., Kaleva, Mich.

[22] Filed: Apr. 24, 1975

[21] Appl. No.: 571,280

[52] U.S. Cl. ..... 5/38; 5/12 R

[51] Int. Cl.[2] ..... A47C 17/14

[58] Field of Search ..... 5/12, 13, 37 R, 38; 297/440

[56] References Cited

UNITED STATES PATENTS

| | | | |
|---|---|---|---|
| 2,438,127 | 3/1948 | Poskin | 5/38 |
| 3,329,977 | 7/1967 | Heller | 5/37 R |
| 3,872,523 | 3/1975 | Garza | 5/12 R |

*Primary Examiner*—Casmir A. Nunberg
*Attorney, Agent, or Firm*—Max R. Kraus

[57] ABSTRACT

A sofa bed comprising a seat section, a back section pivotally movable with respect to said seat section and pivotally movable from an upright position adjacent said seat section where it forms a sofa, to a horizontal position adjacent said seat section to form a full size bed. The back section has leg means pivotally secured thereto, with the leg means positioned in leg receiving pockets and in out-of-the-way position when the back section is in an upright position, with the leg means pivotally movable to a substantially upright position when the back section is in a horizontal position to support said back section in such horizontal position adjacent the seat section.

8 Claims, 14 Drawing Figures

14a
22a
24b
38a
16a
34a
84
82
88
86
84'
80
89
91
8
106
100
20a
74a
36a
97
93
94
90
95
38a
102
105
104
10
A
B
12a
12'
18a
27a
20a
98
16'
88'

SOFA BED

BRIEF SUMMARY OF THE INVENTION

An object of this invention is to provide a sofa which is convertible to a substantially full-size bed, which may be economically produced and which requires a minimum of effort to convert same from a sofa to a bed and vice versa.

Another object of this invention is to provide a seat section and a back section, which back section is pivotally movable from its upright position adjacent the seat section where it forms the sofa, to a horizontal position adjacent the inner side of the seat section to provide a substantially full-size bed, and wherein the back section is provided with legs which are normally hidden from view but which are extendible to a substantially upright position to thereby support the back section in its horizontal position.

Another object of this invention is to provide a sofa bed of the foregoing character having locking means for locking the back section in its upright position where the unit serves to function as a sofa and wherein the back section has pivotally mounted legs which when the back section is in upright position are in out-of-the-way position, and which legs are positionable to a substantially upright leg supporting position when the back rest is pivoted to a horizontal position, and where the back rest is provided with stop means for limiting the upright position of the leg means when in leg supporting position.

BRIEF DESCRIPTION OF THE DRAWINGS

In the drawings:

FIGS. 1 THROUGH 4

The first embodiment of the invention illustrated in FIGS. 1 to 4, inclusive, will be first described.

Figures 1, 2, 3, 4:
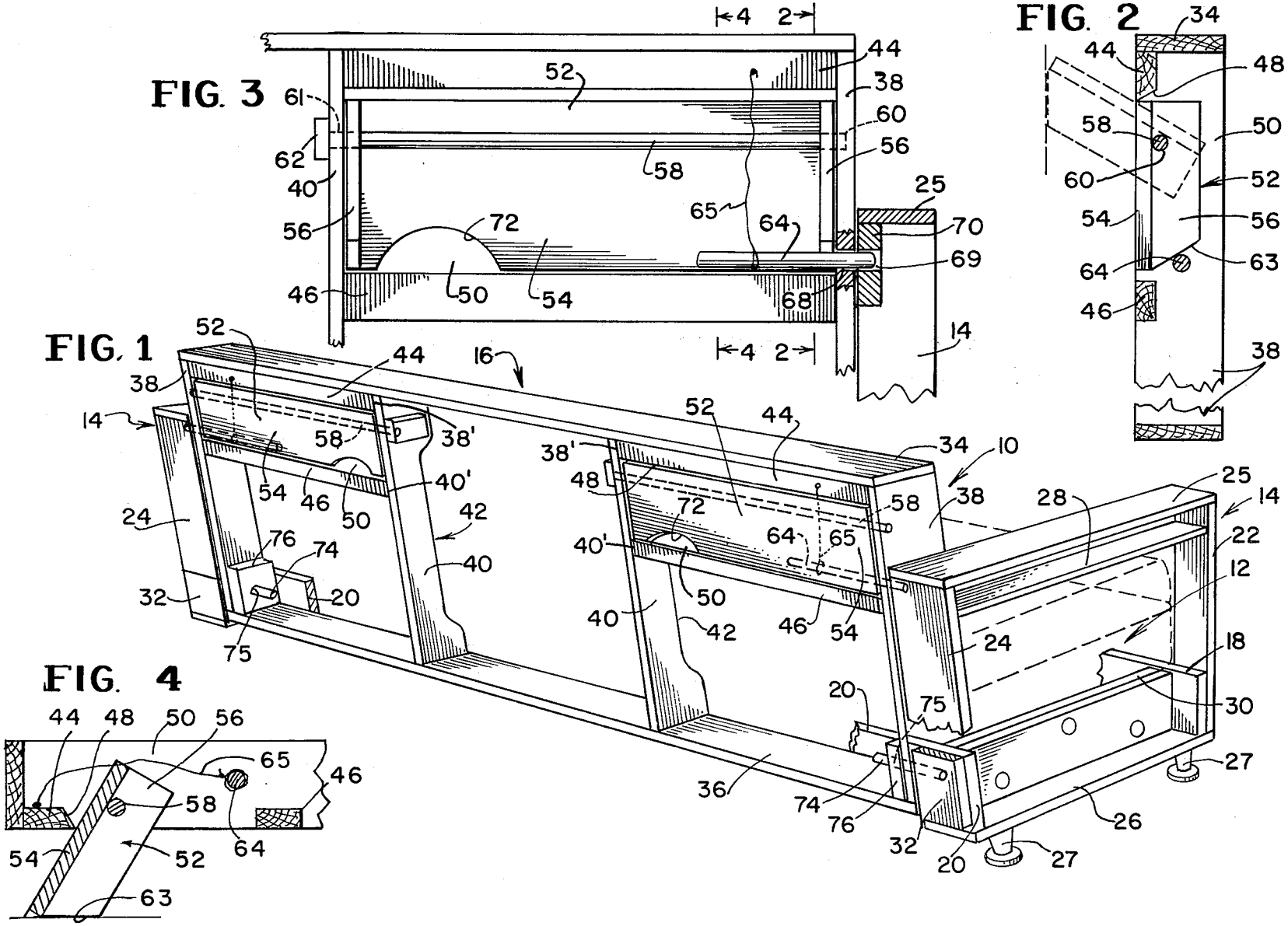
FIG. 1 is a rear perspective view of the framework of the sofa bed showing the back section in upright position in relation to the seat section so as to form a sofa, the upholstery being removed for the purpose of clarity.
FIG. 2 is a sectional view taken on line 2—2 of FIG. 3, showing in full lines the leg in out-of-the-way position and in dotted lines the leg pivoted to its leg supporting position as when the back section is moved to its horizontal position.
FIG. 3 is an enlarged view of a portion of the back section and a portion of the arm of the sofa.
FIG. 4 is a sectional view taken on line 4—4 of FIG. 3, but showing the leg means in leg supporting position as when the back section is in its horizontal position.

The framework of the sofa bed is generally designated at 10 and comprises a seat frame section generally indicated at 12 which includes a pair of spaced side arm frames generally indicated at 14 which are affixed to the seat frame section. Pivotally secured to the side arm frames 14 is a back frame section generally indicated at 16 which is adapted to be pivoted from a substantially inclined upright position, as shown in FIG. 1 where it functions as the back section for the sofa, to the horizontal position shown in FIG. 4 adjacent the seat section where it functions as a sofa bed, to provide with the seat section the equivalent of a full-size bed. Only that portion of the frame of the seat section is shown which is relevant to the invention herein, it being understood that the portion of the seat section not shown is conventional. The frames of the seat, side arms and back section are made preferably of wood or like material.

The seat frame section 12 includes longitudinally extending lower front and rear rails 18 and 20, respectively, to the opposite ends of which are secured the side arm frames 14. Each of said side arm frames 14 includes vertically extending front and rear strips 22 and 24, connected at their top by a horizontal top strip 25 and at their bottom by a horizontal bottom strip 26. Conventional spaced stationary legs 27 are fixedly secured to the bottom strip 26 of the side arm frames. Secured between the front and rear vertical strips 22 and 24 and below the top strip 26 is a bracing strip 28. Each of the side arm frames 14 is provided with a pair of cross strips 30 which rest on the bottom strip 26. Secured to the longitudinal rear rail 20 of the seat frame section adjacent the opposite ends thereof is a block 32.

The seat frame section 12 is provided with a conventional spring assembly (not shown) on which rests the conventional under seat cushion A and the upper seat cushion B. The seat frame section is suitably upholstered, as are the side arm frames 14.

The back frame section 16 comprises longitudinally extending rails 34 and 36 which extend the length of the back section and which are parallel to each other. The longitudinal rails 34 and 36 are connected at their opposite ends by vertically extending end strips 38. A pair of spaced intermediate strips 40 extend between the rails 34 and 36 and are secured to said rails. The front edge of the intermediate strips has a central recessed portion 42 to accommodate the conventional spring assembly 16' which extends between the opposite ends 38 of the back frame.

Extending between each of the end strips 38 and its adjacent intermediate vertical strip 40 are short strips 44 and a strip 46 which are spaced from each other and which are secured to the end and intermediate strips adjacent the outer edges 38' and 40' of said strips. The bottom edge 48 of the strip 44 is inclined or beveled and serves as a stop for the legs in leg supporting position, as shown in FIG. 4. Leg receiving pockets indicated at 50 are formed between the end strip 38 and its adjacent intermediate strip 40 to thereby form a pair of spaced leg receiving pockets 50, each pocket being adjacent the opposite ends of the back section.

A pair of pivotally supported leg means is provided for supporting the back section. Each leg means, generally indicated at 52, is positioned to be received in its respective pocket 50, as more clearly shown in full lines in FIG. 2. Each said leg means comprises a strip 54 having spaced end strips 56 secured thereto at the opposite ends. The end strips 56 are at right angles to strips 54. The length of each leg means is the distance between the end strip 38 and its adjacent intermediate strip 40. Each leg means 52 is pivotally secured to the back frame by means of a rod 58 which passes through alined openings in the opposite end strips 56 of said leg means. One end of said rod is received in an annular recess 60 in the end strip 38 of the back frame section and the opposite end of said rod extends into an annular opening 61 in the intermediate strip 40. A block 62 is secured to the intermediate strip 40 to close said opening and thereby secure the rod in position. The rod 58 forms a pivot support for pivotal movement of the leg means 52 and said leg means is pivoted with respect to the back frame section. The bottom edge of the end strips 56 of the leg means is inclined or angled as indicated at 63.

Mounted on the inside of each of the leg means 52 is a slideable latching rod 64 which, as best shown in FIG. 3, serves to lock the back section in its upright position, as when it forms a sofa. The outer end of the slideable rod 64 passes through an alined opening 68 in the end strip 38 of the back frame section 16 and passes into an opening 69 in a locking block 70 which is fixedly secured to the side arm frame 14 to effect a locking therewith. The locking block 70 is positioned below the top horizontal strip 25 of the side arm frame 14. A string or the like 65 is attached to the rod 64 and to the back frame section to hold the rod 64 captive.

When the back section is in its upright position, as shown in FIG. 2, said back section may be locked in such upright position by manually engaging the rod 64 and sliding the rod into the openings in the side arm and locking block 70 and thereby maintain the back section in its upright position. When the leg means 52 is in substantially vertical non-use position the slideable latching rod 64 is positioned inwardly of the leg means and would be hidden by the leg strip 54 when viewed from the rear, as shown in FIG. 1. The strip 54 of the leg means 52 has a cutout 72 so that the hand may engage the strip 54 and pivot the leg means 52 outwardly from its non-use position, shown in FIG. 1, to its upright leg supporting position, shown in FIG. 4. When the back frame section 16 is in its upright sofa position, as in FIG. 1, the leg means 52 are pivoted so that they extend vertically and are parallel with the back frame section. This is their non-leg supporting position.

The bottom of the back frame section 16 is pivotally secured to the side arm frame by means of a pivot pin 74 which extends through an opening 75 in the block 76, which block is fixedly secured to the insides of the end strips 38 of the back frame section 16. The pivot pin 74 also extends through an alined opening in the end strips 38 of the back frame and is anchored to the side arm frames 14 by extending between block 32 and rear strip 20. The pivot pin 74 is fixedly secured to said side arm frames 14 and pivotally supports the back frame section 16 and permits pivoting of the back section from the substantially upright position shown in FIG. 1 to the horizontal position shown in FIG. 4.

The normal upright position of the back section is inclined with respect to the seat for normal sitting position, and while the upright position of the back rest is not perpendicular to the seat section it will sometimes herein be referred to as either an upright position or a vertical position with respect to the seat. When the back section is pivoted from its upright position to the horizontal position shown in FIG. 4, the back section extends horizontally outward or rearwardly of the seat section to form a substantially full-size bed. When the back section is pivoted to the horizontal position the leg means 52 are each moved outwardly to an inclined upright position, such as shown in FIG. 4, and the leg means 52 abut against the edge 48 of the strip 44 which serves as the outward stop means for the legs in their extended or leg supporting position. The inclined bottom edge 63 of said leg means rest flat on the floor surface. The two leg means 52 each have a substantial length and both extend substantially two-thirds of the length of the back section and provide ample support for the back section when in a horizontal position. While the leg means 52 are shown in extended leg supporting position in FIG. 4 and at an inclined angle, they will sometimes be referred to as in upright position or substantially vertical position, it being understood that said terms include the angled position shown in FIG. 4.

The back frame section 16 is covered with the conventional upholstery and conventional back pillows are positioned against the back frame section when in sofa position. When the back section is pivoted to its horizontal position the back pillows are removed and the upper seat cushion B is positioned on the horizontal back section so that the cushion A on the seat frame and the cushion B on the back frame section form the same top horizontal plane to provide a full-size bed, similar to that shown in FIGS. 11 and 13.

FIGS. 5 THROUGH 11

FIGS. 5 to 11, inclusive, show a modification in which the frames for the seat section and the arms are like that previously described, and only those portions where the differences are embodied will be described in detail. The portions similar or identical to those in FIGS. 1 to 4, inclusive, will be identified by the same numerals heretofore used followed by the letter *a*.

The seat frame section generally indicated at 12*a* is formed of the same framework as seat frame 12. Secured to the opposite ends of the seat frame section are the side arm frames 14*a*. The seat frame section 12*a* is provided with a conventional spring assembly generally indicated at 12′. The back frame section 16*a* is formed of spaced longitudinally extending rails 34*a* and 36*a* which are connected at their opposite ends by end strips 38*a*. Spacedly secured between the longitudinal rails 34*a* and 36*a* are three cross strips each generally designated at 80. The bottom of said back section, as viewed in upright position in FIG. 7, or the inner end of the back section when viewed in a horizontal position, is pivotally secured to the side arm frames 14*a* by a pin 74*a*, in the manner previously described, to permit pivoting of said back section 16*a*.

Figures 7, 8, 9, 10, 11:
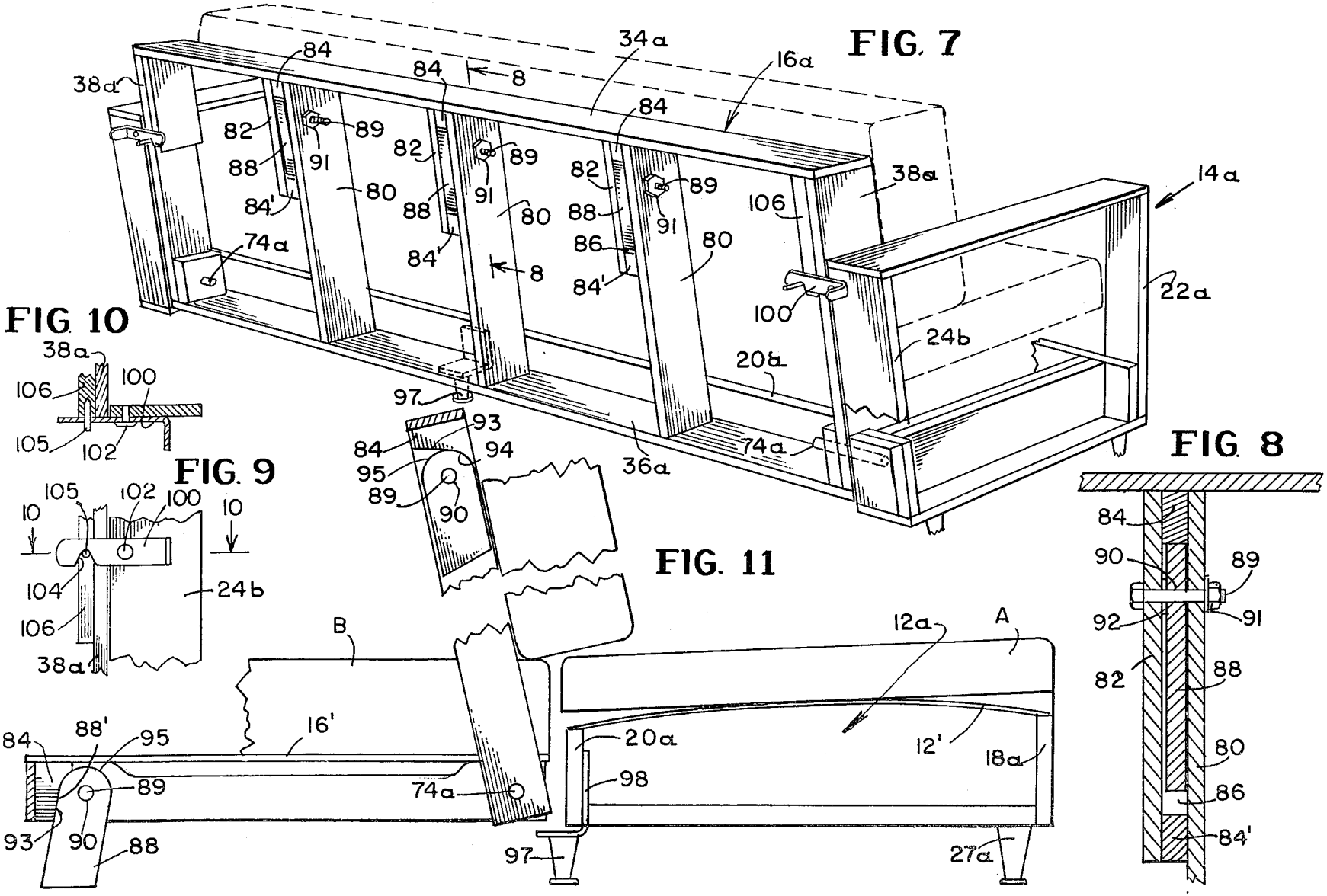
FIG. 7 is a view of the framework of the sofa bed shown in FIG. 5, with the back section in substantially upright position so as to form a sofa, but showing a modified leg and stop means from that of FIG. 5, which modified leg and stop means is shown in FIG. 11 in leg supporting position.
FIG. 8 is an enlarged sectional view taken on line 8—8 of FIG. 7.
FIG. 9 is an elevational view showing the locking means for locking the back section in upright position.
FIG. 10 is a sectional view taken on line 10—10 of FIG. 9.
FIG. 11 is a side elevational view showing the pivoting of the back section from an upright position shown in FIG. 7 to a horizontal position.

Short strips 82 are secured in spaced relation to the cross strips 80 through intermediate spaced blocks 84 and 84', best shown in FIGS. 7 and 8, so that a leg receiving pocket or recess 86 is provided between each of the cross strips 80 and the short strips 82. Each of said leg receiving pockets 86 receives a pivotally mounted leg means 88 which is pivotally secured by a carriage bolt 89 extending through alined opening 90 in said leg means. The carriage bolt is locked in position by means of a nut 91. A friction washer 92 is positioned between the leg means 88 and the strip 82.

The block 84 which serves as a spacer member also serves to provide a leg stop when the leg is in upright supporting position, as shown in FIG. 11. The bottom portion of the block 84 has an inclined surface 93 which is partially curvilinear as at 94 and the top of the leg 88 is curvilinear as at 95 so that when the leg is in its out-of-the-way or non-use position and is recessed in the pocket or recess, as when the back frame section is in upright position, shown in FIG. 11, the curvilinear top 95 of the leg is adjacent the inclined and curvilinear surface of the stop 84. As the back section is lowered to a horizontal position, also shown in FIG. 11, the leg means 88 is extended to its substantially upright position and the outer edge 88' of the leg abuts against the inclined surface 93 of the block 84 to prevent further outward pivoting of said leg. In the construction shown in FIGS. 7, 8 and 11, the leg means 88 are in a vertical position parallel to the back frame section **16*a* when the back frame section is in upright position, as in FIG. 7, with the leg means within the leg receiving pocket 86. The seat frame section 12*a* has the fixed legs 27*a* secured thereto and in addition has an intermediate fixed leg 97 at the rear thereof. The intermediate leg 97 is secured to an angle iron 98 which is secured to the rear longitudinal strip 20*a* of the seat section, as shown in FIG. 11. Similar additional legs may be provided if desired. The intermediate leg 97** serves principally to support the back frame section in its horizontal position.

Figure 5:
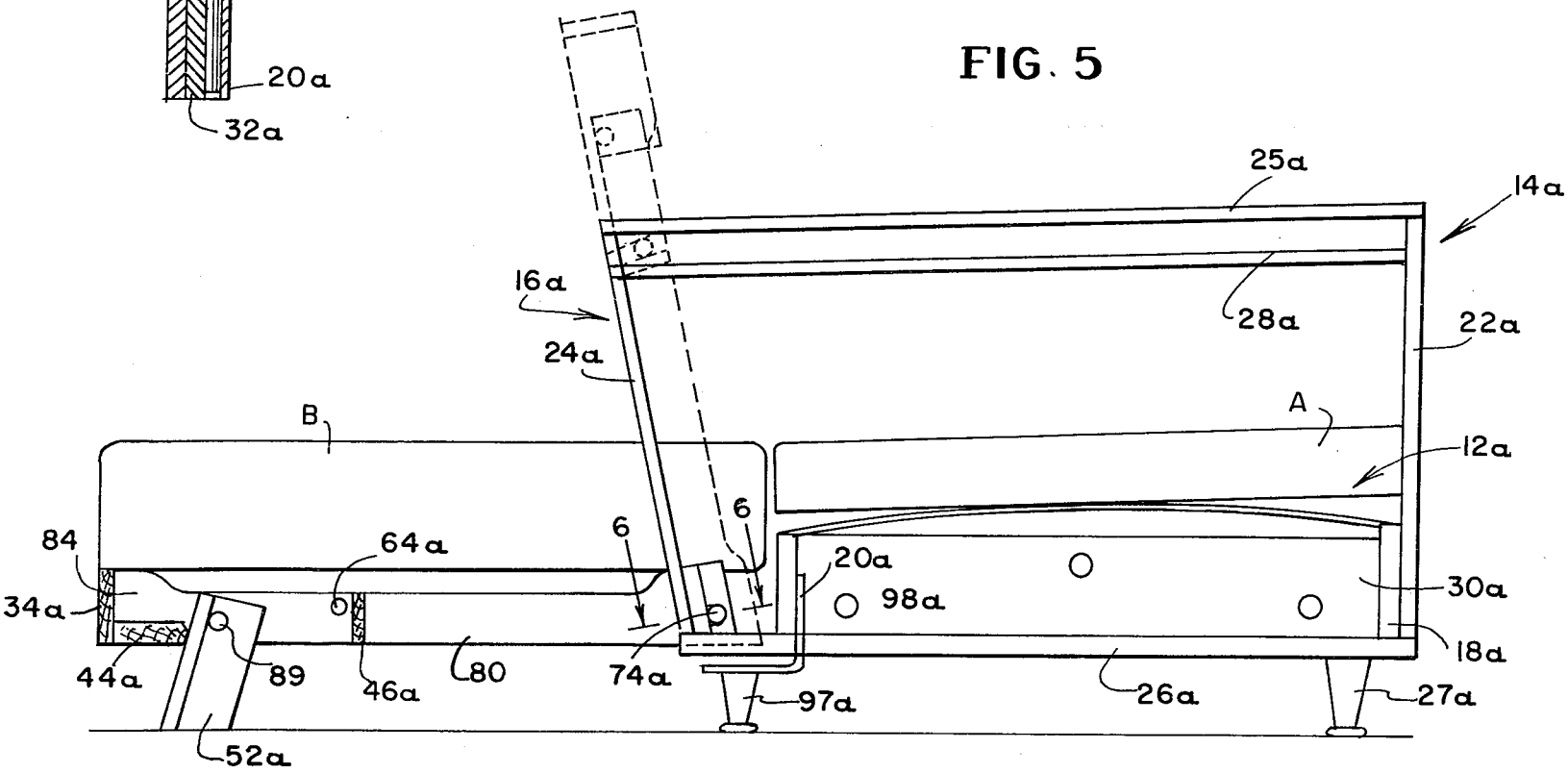
FIG. 5 is a side elevational view of a modification, with the back section pivoted to a horizontal position to form a full-size bed.
Figure 6:
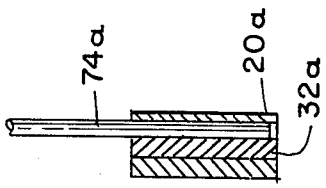
FIG. 6 is an enlarged view partly in section taken on line 6—6 of FIG. 5.

In FIG. 5, the leg means **52*a* are each pivotally supported as in FIG. 7 by a carriage bolt 89, and such leg means 52*a* are received in leg receiving pockets similar to leg receiving pockets 86 of FIG. 7. The leg means 52*a* each engage a strip 44*a* whose bottom edge is inclined or beveled similar to strip 44 of FIG. 4 to serve as stop means for the leg means in extended in-use position as shown in FIG. 5. When the back frame section is in upright position the leg means 52*a* are in a vertical position parallel with the back frame section as in FIG. 7. The legs 52*a* are of a thickness substantially that of the thickness of legs 88**.

Latching means, best shown in FIGS. 7, 9 and 10 are provided for securing the back section in its upright position. Said latching means comprises an L-shaped metal strip 100 having one end bent at right angles to the longitudinal axis of the strip. The latching member 100 is pivotally secured as at 102 to the rear vertical strip of the side arm frame **14*a*. The latching member is recessed or notched as at 104 for engagement with a rearwardly extending pin 105 secured to a wooden strip 106 which is secured to the end strips 38*a* of the back frame member 16*a*. The pin is notched or serrated so that when the latching member 100 is in engagement therewith, such as when the back section is in upright position, the back section is locked in such upright position. To unlock same for moving the back section to a horizontal position, the latching strip 100 is pivoted so that the front end is out of engagement with the pin 105 on the back section and this will permit the back section 16*a*** to be pivoted to a horizontal position.

In this modification it will be seen that the legs 88 (or legs **52*a* of FIG. 5) are within their respective pockets or recesses 86 when the back section is in its upright position so that they are not visible. When the back section is pivoted to its horizontal position the legs 88 (or 52*a*) are moved manually to their upright position. Due to the friction washer 29*a* a tight fit is provided between the leg and its support to maintain the leg in its leg receiving pocket. In this construction the legs 88 (or 52*a***) are positioned vertically when the back section is in its upright position.

Figures 12, 13, 14:
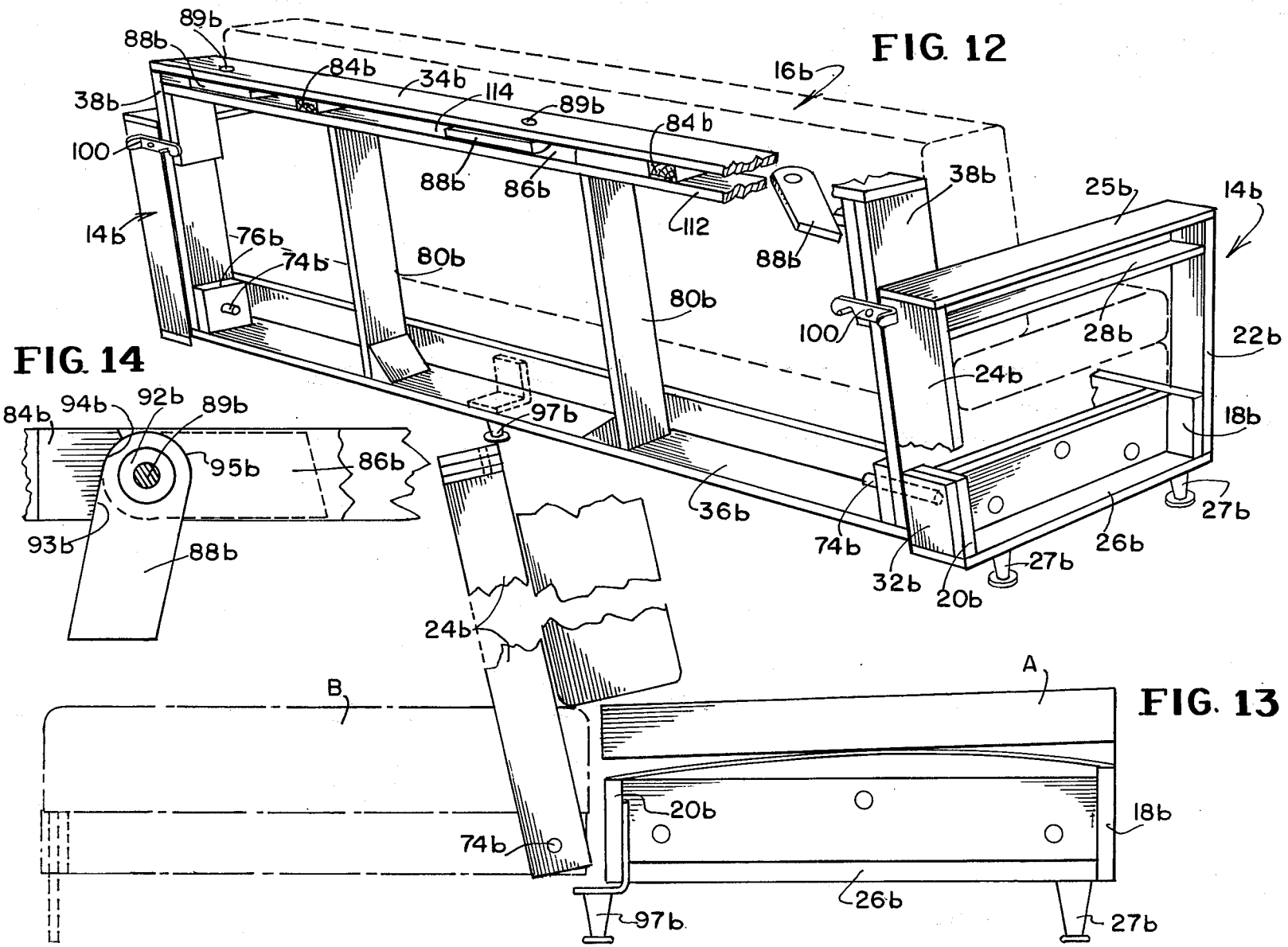
FIG. 12 is a rear perspective view of the framework of another modification with a portion broken away.
FIG. 13 is an elevational view of FIG. 12, showing in dotted lines the back rest positioned in its horizontal position.
FIG. 14 is a partial view of the back section with the leg supporting member in substantially upright leg supporting position to support the back section in a horizontal position.

FIGS. 12, 13 and 14

FIGS. 12, 13 and 14 show another embodiment which differs from the structure shown in FIGS. 5 to 11, inclusive, principally in the manner in which the pivotal leg means on the back frame section are supported. In all other respects the back frame member is similar to that shown in FIGS. 5 through 11 and will not be redescribed. The identical parts will be identified by the same numerals heretofore used followed by the letter *b*.

In this modified version the pivotal legs on the back frame section **16*b* when in non-use position are positioned horizontally when the back rest is in its upright position, as shown in FIG. 12, and said legs are pivoted to their upright leg supporting position when the back rest is pivoted to its horizontal position, such as shown in FIG. 14**.

The back frame section **16*b* includes longitudinal rails 34*b* and 36*b* which are connected by end strips 38*b*, similar to that previously described. Spaced from the longitudinal rail 34*b* and secured thereto by spacing blocks 84*b* is another longitudinal rail 112 which provides a plurality of leg receiving pockets 86*b* between the longitudinal rails 34*b* and 112. A plurality of legs 88*b*, each of which is pivotally secured by means of a pin 89*b* which extends through openings in the rails 34*b* and 112 and through an alined opening in the top of the leg 88*b* has a friction washer 92*b* interposed between the leg and one of said rails, as shown in FIG. 14. The spacing blocks 84*b* also serve as stop means for the legs in their extended upright position, as best seen in FIG. 14, and the surface of the spacing blocks has surfaces 93*b* and 94*b*, similar to surfaces 93 and 94, and the top of the leg has a curvilinear top edge 95*b*, similar to the leg 88**.

When the back section is lowered to its horizontal position, the leg is pivoted outwardly to its upright supporting position, as shown in FIG. 14. In non-use position shown in FIG. 12, when the back section is in an upright position the plane of the leg is horizontal and parallel to the plane of the longitudinal rails **34*b* and 112. In the FIGS. 1 through 11** embodiment the leg when in non-use position is positioned vertically and at right angles to the plane of the top longitudinal rail of the back section.

What is claimed is:

1. A sofa bed comprising, a seat section, a back section pivotally movable with respect to said seat section and pivotally movable from an upright position adjacent said seat section where it forms a sofa to a horizontal position adjacent said seat section to form a bed, said back section having a pair of longitudinally extending leg means pivotally secured thereto with said longitudinally extending leg means in out-of-the-way position when the back section is in an upright position, with said longitudinally extending leg means movable to a substantially upright position when said back section is in a horizontal position to support said back section in such horizontal position adjacent said seat section, each said longitudinally extending leg means extending from adjacent each of the opposite sides of said back section longitudinally inward a substantial portion of the length of said back section so that the pair of longitudinally extending leg means when in leg supporting position extend substantially at least one-half of the length of said back section.

2. A sofa bed as set forth in claim 1 in which locking means are provided to secure said back section in upright position.

3. A sofa bed as set forth in claim 1 in which the back section has a frame provided with a pair of leg receiving pockets and said leg means pivotally mounted and positioned in said pockets when said back section is in substantially upright position, said leg means being pivoted outwardly of said leg receiving pockets when said back section is in a horizontal position.

4. A sofa bed as set forth in claim 1 in which the seat section includes a pair of spaced side arms at the opposite sides of the seat section, and in which the back section has a back frame and means for pivotally securing said back frame to said side arms which includes a pivot pin extending through each of the opposite sides of the back frame and connected to the adjacent side arm.

5. A sofa bed as set forth in claim 3 in which stop means are provided to limit the outward movement of said leg means with respect to said back frame when said back frame is in a horizontal position.

6. A sofa bed as set forth in claim 4 in which a slideable rod engages the frames of the back section and the side arms for locking the back section in upright position relative to the seat section.

7. A sofa bed as set forth in claim 1 in which the back section has a frame member formed of a pair of spaced longitudinally extending rails connected at their opposite ends by end strips and spaced intermediate strips extending between said longitudinally extending rails and connected thereto, one of each of the pair of longitudinally extending leg means being pivotally connected between an end strip and an adjacent intermediate strip.

8. A sofa bed as set forth in claim 7 in which a longitudinally extending short strip is secured adjacent one of said longitudinally extending rails which forms the top rail of the back frame member with said short strip extending between the end strip and the adjacent intermediate strip and said short strip being engaged by the longitudinally extending leg means to hold said longitudinally extending leg means in leg supporting position.

* * * * *